United States Patent [19]

Sharber

[11] 4,137,584

[45] Feb. 6, 1979

[54] INSECT AND REPTILE BARRIER FOR OUTDOORSMEN

[76] Inventor: Norman G. Sharber, 515 W. Vavasupi Rd., P.O. Box 1059, Flagstaff, Ariz. 86002

[21] Appl. No.: 838,494

[22] Filed: Oct. 3, 1977

[51] Int. Cl.[2] ..... A47C 27/08

[52] U.S. Cl. ..... 5/344; 5/365; 5/371; 43/109

[58] Field of Search ..... 43/58, 107–109, 43/124; 47/23, 289; 5/343, 344, 365, 369–371

[56] References Cited

U.S. PATENT DOCUMENTS

| | | | |
|---|---|---|---|
| 1,624,797 | 4/1927 | Morehouse | 5/344 |
| 2,101,008 | 11/1937 | Mayer | 43/109 |
| 3,027,610 | 4/1962 | Liddell | 43/124 |
| 3,237,904 | 3/1966 | Abruzese | 5/344 |
| 3,761,975 | 10/1973 | Personett | 5/365 |

*Primary Examiner*—Casmir A. Nunberg
*Attorney, Agent, or Firm*—Cahill, Sutton & Thomas

[57] ABSTRACT

A ground cloth mounted barrier extending around an occupant in a sleeping bag shields the occupant from reptiles and crawling insects. The barrier, being of smooth surfaced material, such as vinyl plastic, precludes a sufficient gripping surface for the insects and the reptiles to permit them to traverse the barrier. The underlying ground cloth shields against intrusion beneath the barrier or from the ground from within the barrier. A peripheral smooth surfaced section of the ground cloth extending lateral to the barrier further discourages intrusion of reptiles by providing a large span over which they cannot obtain a grip.

6 Claims, 5 Drawing Figures

INSECT AND REPTILE BARRIER FOR OUTDOORSMEN

The present invention is directed to barriers and, more particularly, to barriers for safeguarding an area against intrusion by crawling insects and reptiles.

Possibly the greatest detriment to sleeping outdoors is the real or imagined fear of being beset upon in the nighttime by crawling insects and/or reptiles. This fear, though predicated in part on the attendant health hazard of some moment but the hazard is seldom fatal; moreover, it is a risk either deliberately or knowledgeably undertaken. The psychological aspect of the fear is, however, far less easily manageable and of substantially much greater import. That is, many rational intelligent persons simply refuse to camp and sleep outdoors because the thought of having an insect crawl or a reptile slither upon them or even join them in a sleeping bag is too horrible a thought to contemplate. Consequently, many people will never experience the pleasures of backpacking into remote areas or the pleasures of sleeping away from the trappings of civilization.

Because it has long been recognized that the above described real and psychological fears exist, various devices and apparatus have been developed to sooth or alleviate these and apparatus have been developed to sooth or alleviate these fears. The most common of such devices and apparatus is that of a cot which provides off-ground support for an occupant. The cot does provide some protection against intrusion of insects and reptiles but only as against those insects and reptiles which cannot or do not have the inclination to climb up the legs of the cot. Therefore, a whole host of devices have been developed which, in essence, partially or completely encapsulate an occupant within a sheath, cocoon or enclosure. The following United States patents are representative of various ones of such devices, U.S. Pat. Nos. 1,805,415, 1,892,378, 2,015,588, 2,301,511, 2,531,501, 2,659,905, 3,840,919 and 3,860,980. All of these devices rely upon one main feature to inhibit unwanted intrusion: the development of a sealed or sealable enclosure. However, unless the enclosure is completely and well sealed, sufficient gaps will exist to permit unwanted intrusion. Moreover, because the need for the development of a cocoon-like enclosure, physical movement within the enclosure is generally restricted resulting in discomfort or inconvenience to the occupant. Where weight is an important consideration during a camping trip, the weight of such enclosures may necessitate some real soul searching to determine whether it should be taken along. Unfortunately, many persons will decide that the weight penalty is too great and that the prospect of sleeping outdoors without the security of the enclosure is too frightening, thereby foregoing the pleasures available from such a camping trip.

The present invention is directed to a barrier defining a perimeter about a ground cloth. The barrier is constructed of smooth surfaced material, such as one of the vinyl plastics, having a surface which makes it impossible or extremely difficult for crawling insects in traverse. Moreover, reptiles will generally not cross such a smooth surface since their scales cannot develop sufficient purchase against the surface to propel them. Thereby, the barrier effectively precludes unwanted intrusion of crawling insects and slithering reptiles. To further assure non-intrusion of reptiles, an extended smooth surfaced section of the ground cloth may extend laterally from the barrier such that the total span from the edge of the smooth surfaced ground cloth to the barrier is greater than that which a reptile will span without firm engagement with its underside scale edges. The barrier itself may be air inflatable for compact storage and lightweight or the barrier may be of readily compressible foam-like material to establish the shape of the barrier and yet allow compact storage coupled with lightweight.

It is therefore a primary object of the present invention to provide a barrier against intrusion by crawling insects and reptiles.

Another object of the present invention is to provide a means for quelling the psychological fears attendant sleeping on the ground.

Still another object of the present invention is to provide a smooth surfaced barrier which precludes traverse thereof by crawling insects and reptiles.

Still another object of the present invention is to provide a barrier for avoiding the health hazards attendant crawling insects and reptiles.

A further object of the present invention is to provide a ground cloth supported barrier for protecting the space interior the barrier from the intrusion of insects and reptiles.

A still further object of the present invention is to provide a smooth surfaced extension lateral to a ground cloth supported barrier for precluding traverse thereacross by reptiles.

A yet further object of the present invention is to provide a lightweight transportable security device for soothing the psychological fears attendant sleeping on the ground.

These and other objects of the present invention will become apparent to those skilled in the art as the description thereof proceeds.

The present invention may be described with greater specificity and clarity with reference to the following figures, in which.

In preparation for or when camping, many people speak of fears of molestation by various wild animals. However, such talk is generally without any real conviction and is generally engaged in to hide or disguise the real fears present. These real fears are most often directed to the fear of sharing one's sleeping bag or clothing with crawling insects or slithering reptiles. The health hazard attendant such insects and reptiles is, of course, always present but generally not of substantial moment. Instead, the innate and irrational fear of being touched by or even in proximity to seemingly horrible crawling insects and reptiles is so strong as to sometimes place a person in a catatonic state.

Figure 1:
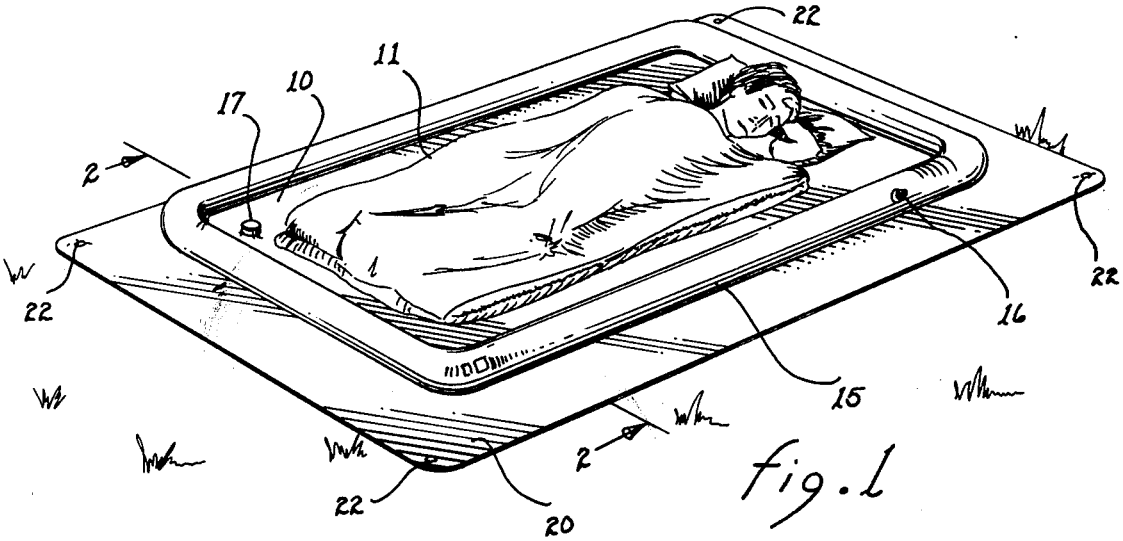
FIG. 1 is a perspective view illustrating the present invention in use as a barrier and surrounding a camper sleeping in a sleeping bag.

The basis for both the health hazards and the innate fears can be alleviated, if not laid to rest, by providing a barrier for insulating or isolating the person during rest or sleep from crawling insects and reptiles. The barrier, pictorially illustrated in FIG. 1, provides the requisite isolation from crawling insects and reptiles.

Figure 2:
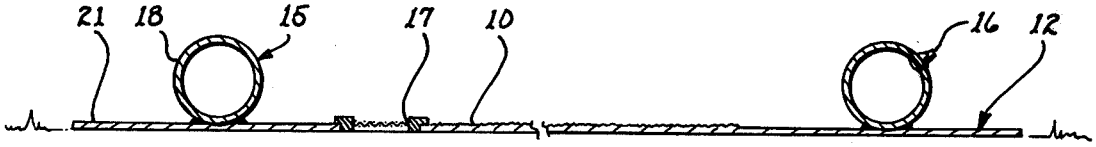
FIG. 2 is a cross-sectional view taken along lines 2—2 as shown in FIG. 1.
Figure 3:
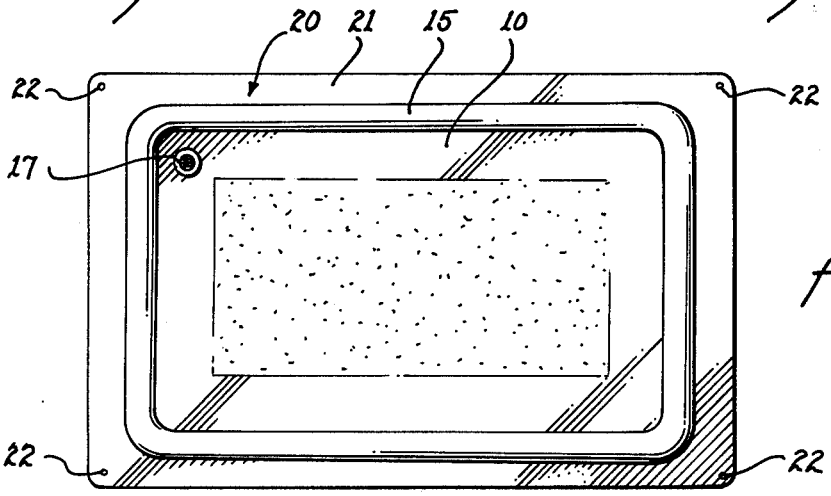
FIG. 3 is a top view of the present invention.

The constructional and operational features of the barrier will be discussed with primary reference to FIGS. 1, 2 and 3. A ground cloth 10 is dimensioned to support the activity to be conducted within the barrier. Such activity is usually primarily that of supporting a single occupant within a sleeping bag, such as sleeping bag 11. However, supplies and equipment, such as food, tables and chairs, can be equally well protected by the barrier. Moreover, it can be used for picnics as well as for sun bathing purposes.

A tubular element 15 is secured to the perimeter of ground cloth 10 in such a manner as to preclude any gaps therebetween. Tubular element 15 may be developed as an inflatable tube closed upon itself. A valve 16 is included for inflation and deflation of the tubular element, its location can be suitably altered from that illustrated, if necessary. Because the combination of tubular element 15 and ground cloth 10 serves as a catch basin for rainwater, a cappable vent 17 is provided to effect drainage of the water without having to lift and overturn the barrier/ground cloth combination.

Exterior surface 18 of tubular element 15, particularly the outwardly facing half of the surface, must be smooth surfaced in order to render it very difficult or impossible for crawling insects to obtain sufficient grip to crawl up the side of the tubular element. Presently, there are commercially available vinyl plastics and similar materials which have a sufficiently smooth surface to serve this purpose.

Generally, reptiles will not traverse over an area unless their repetitively extending and contracting under surface scales can obtain a grip on the underlying surface since lack of such grip renders the reptiles essentially helpless. However, they will traverse short spans of a length somewhat dependent upon the size of the reptile without affirmative contact with the surface. As the exterior and top surface of tubular element 15 is smooth surfaced, it will afford no grip for a reptile. Accordingly, a reptile will be inclined to hesitate to traverse the tubular element unless the remaining part of its body is solidly and completely supported by the adjacent ground surface. Thus, tubular element 15, by itself, will serve as a barrier for most reptiles found in the continental United States.

To further insure against intrusion by reptiles, a laterally extending peripheral section 20 of ground cloth 10 may be incorporated. Upper surface 21 of section 20 is smooth surfaced to a degree insufficient for a reptile to bear against it for motive power. Accordingly, section 20 will increase the span over which a reptile must traverse in order to breach tubular element 15 and alight on ground cloth 10. With the increased span created by section 20, it is extremely unlikely that any reptile will have sufficient motivation to attempt to cross section 20 and tubular element 15. Hence, a very effective barrier against all reptiles can be established.

To insure continuing lateral extension of section 20, grommets or apertures 22 may be disposed at the corners or along the perimeter of section 20. Stakes, engaging the apertures directly or through tie-down lines, maintain the section in the stretched-out configuration illustrated.

Figure 4:
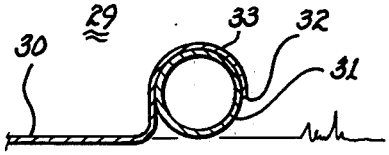
FIG. 4 illustrates a first variant of the present invention.

FIG. 4 is a partial cross-sectional view of a first variant 29 and illustrating a ground cloth 30 extending up and partially over an inflatable tubular element 31. It is to be understood that the terminal edge 32 of overlapping segment 33 may extend about tubular element 31 further than depicted or it may terminate at a point shorter than depicted. To insure against traverse of tubular element 31 and the overlapping segment by insects and reptiles, the parts of these elements located in proximity to at least the outer half of the tubular element must be smooth surfaced.

Figure 5:
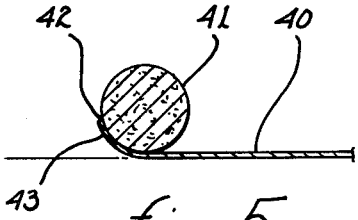
FIG. 5 illustrates a second variant of the present invention.

FIG. 5 is a partial cross-sectional view of a second variant 39 wherein ground cloth 40 extends beneath and upwardly about the outer surface of tubular element 41. Terminating edge 42 of overlapping segment 43 may be located at the point indicated in the figure or it may be positioned upwardly or downwardly therefrom depending on cost and manufacturing considerations.

Herein, tubular element 41, instead of being inflatable, is developed from a compressible foam-like material 44. The use of such material obviates the possibility of puncture and deflation with only a slight penalty of weight and compactness in storage. The exterior surface of tubular element 41 and the exterior surface of overlapping segment 43 of ground cloth 40 is developed from smooth surfaced material for the reasons stated above.

While the tubular element depicted in FIG. 1 and in the variants shown in FIGS. 4 and 5, illustrates a cylindrical element, it is to be understood that the cross-sectional configuration may be square, rectangular of of any other configuration provided only that it include a smooth surfaced perimeter at a relatively steep angle to preclude traverse thereacross by crawling insects. Additionally, the tubular element is preferably three inches or more in height to discourage traverse thereof by reptiles and high reaching insects.

Aside from the above discussed benefits with respect to insects and reptiles, the present invention has a further benefit. During nighttime, cooler and more dense air will flow across the ground and collect in low areas. Usually, the layer of cool air is only a few inches deep, particularly if it is flowing. The barrier surrounding the sleeping camper serves as an effective baffle to channel the cool air away from the encircled occupant. Thus, the occupant is protected against the cool nighttime ground air flow.

While the principles of the invention have now been made clear in an illustrative embodiment, there will be immediately obvious to those skilled in the art many modifications of structure, arrangement, proportions, elements, materials, and components, used in the practice of the invention which are particularly adapted for specific environments and operating requirements without departing from those principles.

I claim:

1. Apparatus for protecting an occupant within a predetermined area against intrusion by crawling insects and reptiles, said apparatus comprising in combination:

a. a ground cloth for supporting the occupant, said ground cloth having a perimeter defining the predetermined area;

b. an inflatable smooth surfaced barrier of vinyl plastic secured to said ground cloth in proximity to the perimeter of said ground cloth for establishing an encircling enclosure about the occupant;

c. said barrier including a smoothly curved outer lateral wall having a smooth surface devoid of surface discontinuities for preventing crawling insects and reptiles from obtaining sufficient traction to traverse said barrier;

whereby, said smooth surface outer lateral wall, in combination with the vertical height presented by said outer lateral wall, inhibits passage of crawling insects and reptiles within the predetermined area.

2. The apparatus as set forth in claim 1 wherein said barrier is inflatable to a height of at least three inches.

3. The apparatus as set forth in claim 1 wherein said barrier is circular in cross-section.

4. The apparatus as set forth in claim 1 including a peripheral smooth surfaced section extending laterally about said barrier for increasing the span of smooth surfaced material.

5. The apparatus as set forth in claim 4 wherein said barrier is inflatable to a height of at least three inches.

6. The apparatus as set forth in claim 4 wherein said barrier is circular in cross-section.

* * * * *